US005897287A

United States Patent [19]

Berger et al.

[11] Patent Number: 5,897,287

[45] **Date of Patent: *Apr. 27, 1999**

[54] ELECTRONIC RIDE CONTROL SYSTEM FOR OFF-ROAD VEHICLES

[75] Inventors: Alan D. Berger, Winfield; Ketan B. Patel, Carol Stream, both of Ill.

[73] Assignee: Case Corporation, Racine, Wis.

[ * ] Notice: This patent issued on a continued prosecution application filed under 37 CFR 1.53(d), and is subject to the twenty year patent term provisions of 35 U.S.C. 154(a)(2).

[21] Appl. No.: 08/718,925

[22] Filed: Sep. 25, 1996

[51] Int. Cl.[6] ..... B66F 9/00

[52] U.S. Cl. ..... 414/699; 60/469; 91/433; 414/719

[58] Field of Search ..... 414/685, 697, 414/699, 719; 60/469; 91/433

[56] References Cited

U.S. PATENT DOCUMENTS

| | | | |
|---|---|---|---|
| 4,904,150 | 2/1990 | Svensson et al. | 414/719 |
| 4,953,723 | 9/1990 | Saotome et al. | 212/159 |
| 4,995,517 | 2/1991 | Saotome | 212/146 |
| 5,034,892 | 7/1991 | Saotome | 364/424.07 |
| 5,147,172 | 9/1992 | Hosseini . | |
| 5,195,864 | 3/1993 | Drake et al. . | |
| 5,520,499 | 5/1996 | Ufneil et al. . | |
| 5,622,226 | 4/1997 | Hausman et al. | 172/4.5 |

FOREIGN PATENT DOCUMENTS

| | | |
|---|---|---|
| 0 378 129 A1 | 7/1990 | European Pat. Off. . |
| 0 747 797 A1 | 12/1996 | European Pat. Off. . |
| 5-60104 | 3/1993 | Japan . |
| 5-163746 | 6/1993 | Japan . |
| 7-32848 | 2/1995 | Japan . |
| 8-13546 | 1/1996 | Japan . |
| 8-302753 | 11/1996 | Japan . |

*Primary Examiner*—Donald W. Underwood
*Attorney, Agent, or Firm*—Foley & Lardner

[57] ABSTRACT

A control system for improving the roadability of a wheeled excavator is disclosed herein. The excavator is the type including an implement such as a bucket or backhoe which is moved relative to the excavator by hydraulic actuators. Hydraulic fluid is applied to the actuators via electronic valves which are controlled by an electronic controller. Based upon acceleration of the vehicle, the electronic controller controls the electronic valve to maintain fluid pressure in the actuator or the acceleration substantially constant. Additionally the controller can be configured to maintain the average position of the implement generally constant. By controlling the pressure in the hydraulic actuator, the undesirable bouncing or pitching of the excavator can be reduced when the vehicle is traveling at road or loading speeds.

28 Claims, 2 Drawing Sheets

ELECTRONIC RIDE CONTROL SYSTEM FOR OFF-ROAD VEHICLES

FIELD OF THE INVENTION

The present invention relates to controlling the ride of a work vehicle such as a wheeled loader or tractor including a bachhoe, bucket or implement. In particular, the present invention relates to controlling the action of the backhoe, bucket or other implement to improve the ride of the associated off-road or construction vehicle.

BACKGROUND OF THE INVENTION

Various types of off-road or construction vehicles are used to perform excavation functions such as leveling, digging, material handling, trenching, plowing, etc. These operations are typically accomplished with the use of a hydraulically operated bucket, backhoe or other implement. These implements include a plurality of linkages translationally supported and rotationally supported, and are moved relative to the supports by hydraulic cylinders or motors. As a result of the type of work excavators are used to perform (i.e. job site excavation) these excavators are often required to travel on roads between job sites. Accordingly, it is important that the vehicle travel at reasonably high speeds. However, due to the suspension, or lack thereof, and implements supported on the vehicle, vehicle bouncing, pitching or oscillation occurs at speeds satisfactory for road travel.

In an attempt to improve roadability, various systems have been developed for interacting with the implements and their associated linkages and hydraulics to control bouncing and oscillation of excavation vehicles while operating at road speeds. One such system includes circuitry for lifting and tilting an implement combined with a shock absorbing mechanism. This system permits relative movement between the implement and the vehicle to reduce pitching of the vehicle during road travel. To inhibit inadvertent vertical displacement of the implement, the shock absorbing mechanism is responsive to lifting action of the implement. The shock absorbing mechanism is responsive to hydraulic conditions indicative of imminent tilting movement of the implement thereby eliminating inadvertent vertical displacement of the implement.

Other systems for improving the performance of excavators have included accumulators which are connected and disconnected to the hydraulic system depending upon the speed of the vehicle. More specifically, the accumulators are connected to the hydraulic system when the excavator is at speeds indicative of a driving speed and disconnected at speeds indicative of a loading or dumping speed.

These systems may have provided improvements in roadability, but it would be desirable to provide an improved system for using the implements of excavation vehicles to improve roadability. Accordingly, the present invention provides a control system which controls the pressure in the lift cylinders of the implement(s) associated with an excavation vehicle based upon the acceleration of the vehicle.

SUMMARY OF THE INVENTION

An embodiment of the present invention provides a control system for an excavator of the type including an implement moveable relative to the excavator. The system includes a hydraulic fluid source, a hydraulic actuator, and an electronic valve coupled to the source and the actuator to control the flow of hydraulic fluid applied to the actuator by the source. A pressure transducer is provided to generate a pressure signal related to the pressure in the actuator. The system also includes an electronic controller coupled to the electronic valve and the pressure transducer. The controller determines the acceleration of the excavator based upon the pressure signal, and applies control signals to the electronic valve to cause the electronic valve to control the flow of hydraulic fluid applied to the actuator to maintain the pressure signal substantially constant.

An alternative embodiment of the control system includes an accelerometer instead of the pressure transducer. The accelerometer is coupled to the excavator to generate an acceleration signal representative of the acceleration of the excavator. The controller determines the acceleration of the excavator based upon the acceleration signal, and applies control signals to the electronic valve to cause the electronic valve to control the flow of hydraulic fluid applied to the actuator to maintain the acceleration signal substantially constant at a value of zero.

The present invention also relates to an excavator including a wheeled vehicle, an implement movably supported by the vehicle, a hydraulic fluid source supported by the vehicle, and a hydraulic actuator coupled between the implement and vehicle to move the implement relative to the vehicle. An electronic valve is coupled to the source and the actuator to control the flow of hydraulic fluid applied to the actuator by the source. The excavator also includes means for generating an acceleration signal representative of the acceleration of the vehicle, and an electronic controller coupled to the electronic valve and the accelerometer. The controller determines the acceleration of the excavator based upon the acceleration signal, and applies control signals to the electronic valve to cause the electronic valve to control the flow of hydraulic fluid applied to the actuator to maintain the pressure signal substantially constant based upon the acceleration signal.

DETAILED DESCRIPTION OF THE PREFERRED EMBODIMENTS

Figure 1:
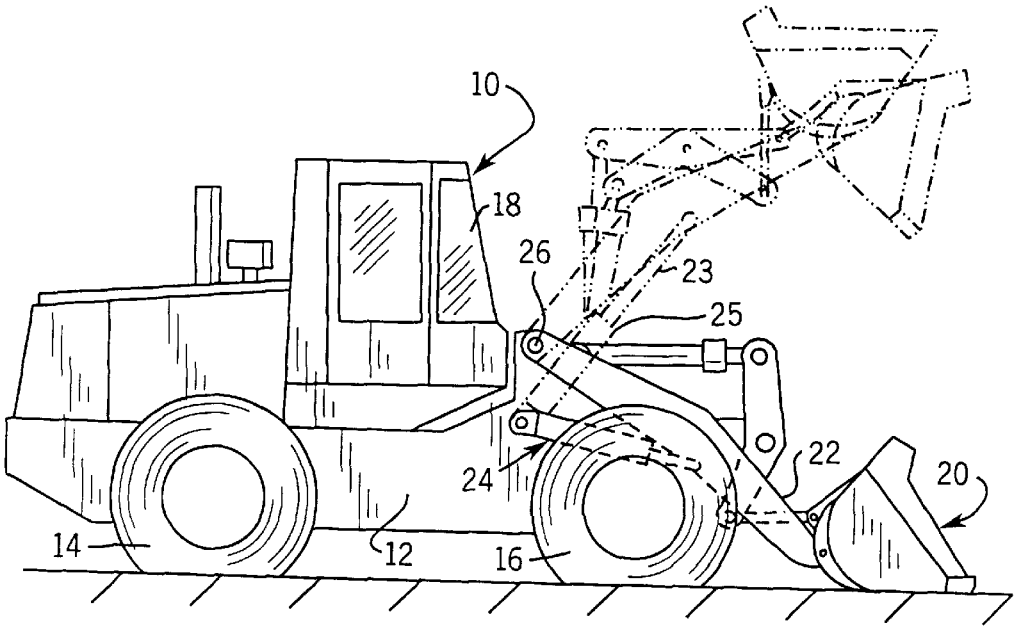
FIG. 1 is a schematic side elevation view of a wheel loader equipped with a bucket or other suitable implement shown in various elevational and tilted positions.

Referring now to FIG. 1, a wheel loader 10, which is illustrative of the type of off-road construction vehicle in which the present control system can be employed, is shown. Wheel loader 10 includes a frame 12; air filled tires 14 and 16; an operator cab 18; a payload bucket 20 or other suitable implement; a pair of lift arms 22; a pair of hydraulic actuators 24; hydraulic actuator columns 23; and hydraulic actuator cylinders 25.

Frame 12 of wheel loader 10 rides atop tires 14 and 16. Frame 12 carries the operator cab 18 atop the frame. A pair of lift arms 22 are connected to frame 12 via a pair of arm pivots 26. The lift arms are also connected to the frame by hydraulic actuators 24 which are made up of actuator columns 23 which translate relative to actuator cylinders 25. Payload bucket 20 is pivotally connected to the end of lift arms 22.

Wheel loader 10 includes a hydraulic system 50 coupled to actuators 24 to raise, lower, or hold bucket 20 relative to frame 12 to carry out construction tasks such as moving and unloading the contents thereof. More specifically, hydraulic actuators 24 control movement of the lift arms 22 for moving bucket 20 relative to frame 12. (Bucket 20 may be rotated by a hydraulic actuator 31 which could be controlled by system 50.) Actuator columns 23 extend relative to actuator cylinders 25 forcing lift arms 22 to pivot about arm pivots 26 causing bucket 20 to be raised or lowered, as shown by phantom lines in FIG. 1.

Figure 2:
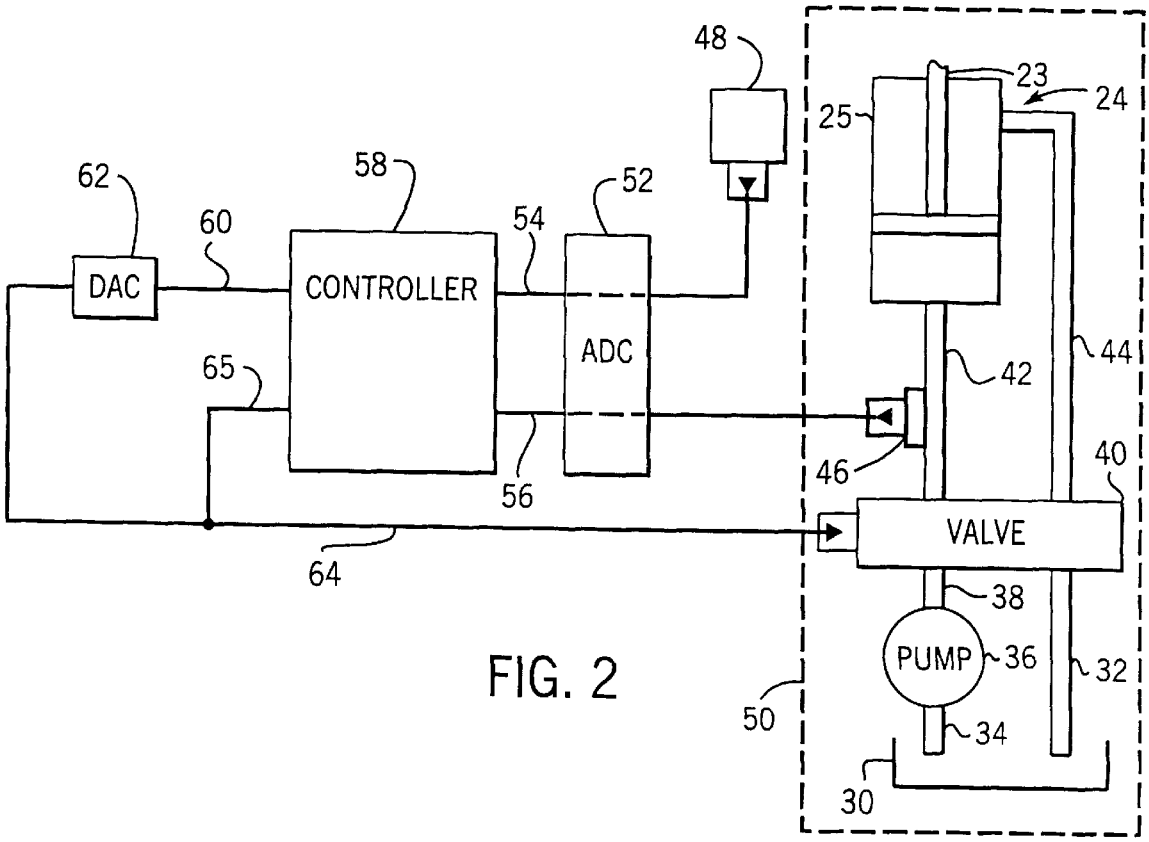
FIG. 2 is a diagrammatic view of a hydraulic actuator system used with the wheel loader illustrated in FIG. 1 and including an electronic controller according to the present invention.

Referring to FIG. 2, the hydraulic system 50 also includes a hydraulic fluid source 30; a hydraulic return line 32; a hydraulic supply conduit 34; a hydraulic pump 36; hydraulic lines 38, 42, and 44; an electronic valve 40; and a pressure transducer 46. Hydraulic system 50 also includes a position sensor 48; an analog-to-digital converter (ADC) 52; a position signal data bus 54; a pressure signal data bus 56; an electronic controller 58; a control signal data bus 60; a digital to analog converter 62; and an analog control signal conductor 64. By way of example, valve 40 may be a Danfoss electro-hydraulic valve with spool position feedback.

Hydraulic fluid source 30 is connected to pump 36 via hydraulic supply conduit 34, pump 36 is connected to electronic valve 40 via line 38, electronic valve 40 is connected to hydraulic actuator 24 via lines 42 and 44, and pressure sensor 46 is also in fluid communication with line 42. Hydraulic actuator 24 is also connected to electronic valve 40 via line 44. Electronic valve 40 is further connected to hydraulic source 30 via hydraulic return line 32 thereby completing the hydraulic circuit of hydraulic system 50. Pressure transducer 46 and position sensor 48 are connected to ADC 52. Electronic controller 58 is connected to ADC 52 via position signal data bus 54 and pressure signal data bus 56, connected to DAC 62 via control signal data bus 60, and connected to DAC 62 via analog control signal bus 64.

Electronic controller 58 operates to keep the pressure in hydraulic actuators 24 relatively constant thereby dampening vertical motions of the vehicle. In operation, pressure transducer 46, which is in fluid communication with the hydraulic fluid, measures the pressure in hydraulic line 42 which is substantially the same as that in hydraulic actuator 24. A signal from pressure transducer 46 is communicated to ADC 52 where the analog sensor signal is converted to a digital signal. Position sensor 48 measures the angular position of the lift arms 22. The analog position sensor signal is also sent to the ADC where it is converted to a digital signal. The sampled position signal and the sampled pressure signal are communicated to electronic controller 58 over data busses 54 and 56 respectively. Using the sampled sensor information electronic controller 58 calculates a digital control signal. The digital control signal is passed over data bus 60 to DAC 62 where the digital signal is converted to an analog control signal that is transmitted over connection 64 to electronic valve 40.

By way of example, controller 58 could be a digital processing circuit such as an Intel 87C196CA coupled to a 12 bit ADC. Furthermore, DAC 62 typically would include appropriate amplification and isolation circuits to protect the associated DAC and control valve 40. Alternatively, DAC 62 could be eliminated by programming controller 58 to generate a pulse-width-modulated (PWM) signal. Valve 40 would in turn be a PWM valve controllable with a PWM signal.

Electronic valve 40 controls the flow of hydraulic fluid into and out of hydraulic actuator 24 thereby causing actuator column 23 to move in or out of actuator cylinder 25. Hydraulic fluid is supplied to electronic valve 40. The fluid originates from hydraulic fluid source 30, through supply conduit 34, to pump 36 which forces the hydraulic fluid through line 38 and into electronic valve 40. Electronic valve 40 controls the ingress and egress of hydraulic fluid to hydraulic actuator 24. Electronic valve 40 controls both the path of flow for the hydraulic fluid and the volumetric flow of hydraulic fluid. Electronic valve 40 directs hydraulic fluid either into line 42 and out of line 44 or into line 44 and out of line 42 depending on the intended direction of travel of actuator 24. The analog control signal received from bus 64 commands electronic valve 40 to control both the direction of hydraulic fluid flow and the volumetric flow of the fluid. By way of example, both the fluid direction signal and the flow volume signal can be generated by DAC 62. However, the flow direction signal may be generated at a digital I/O 65 of controller 58, and if a PWM valve is used, the PWM signal applied to the valve can also be generated at a digital I/O. Excess hydraulic fluid is directed by electronic valve 40 through return line 32 and back to hydraulic fluid source 30.

Figure 3:
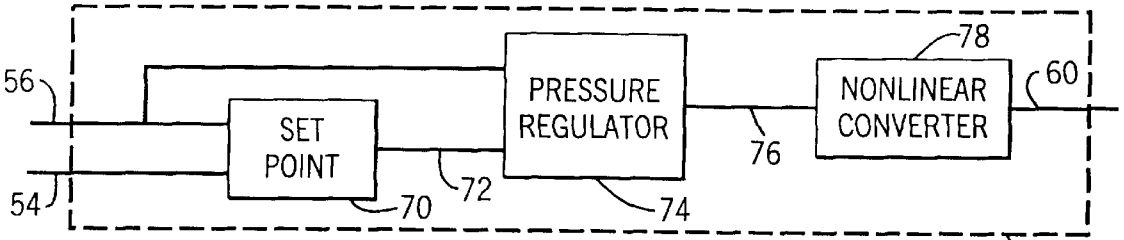
FIG. 3 is a schematic block diagram of the ride control system forming part of the present invention.

Referring to FIG. 3, electronic controller 58 includes a setpoint calculator 70; a pressure regulator 74; a nonlinear converter 78; a pressure set point signal bus 72; and an ideal pressure control signal bus 76.

The input side of electronic controller 58 is connected to data buses 54 and 56. Data buses 54 and 56 are connected to set point calculator 70. Pressure regulator 74 is connected to data bus 56 and set point calculator 70 via pressure set point signal connection 72. Ideal pressure control signal connection 76 connects pressure regulator 74 to nonlinear converter 78. Nonlinear converter 78 connects the output side of electronic controller 58 to data bus 60.

Setpoint calculator 70 calculates the pressure setpoint used by electronic controller 58 to maintain the hydraulic fluid pressure in actuator 24 relatively constant. To calculate the proper pressure setpoint, information from both pressure transducer 46 and position sensor 48 is communicated to pressure setpoint calculator over data bus 56 and 54 respectively. The output of setpoint calculator 70 is a pressure setpoint signal passed over bus 72 to pressure regulator 74. Pressure regulator 74 uses information from pressure set point calculator 70 and from pressure transducer 46 passed over data bus 56 to calculate an ideal pressure control signal. The ideal pressure control signal is passed over bus 76 to nonlinear converter 78. Nonlinear converter 78 outputs a sampled control signal over data bus 60.

Figure 4:
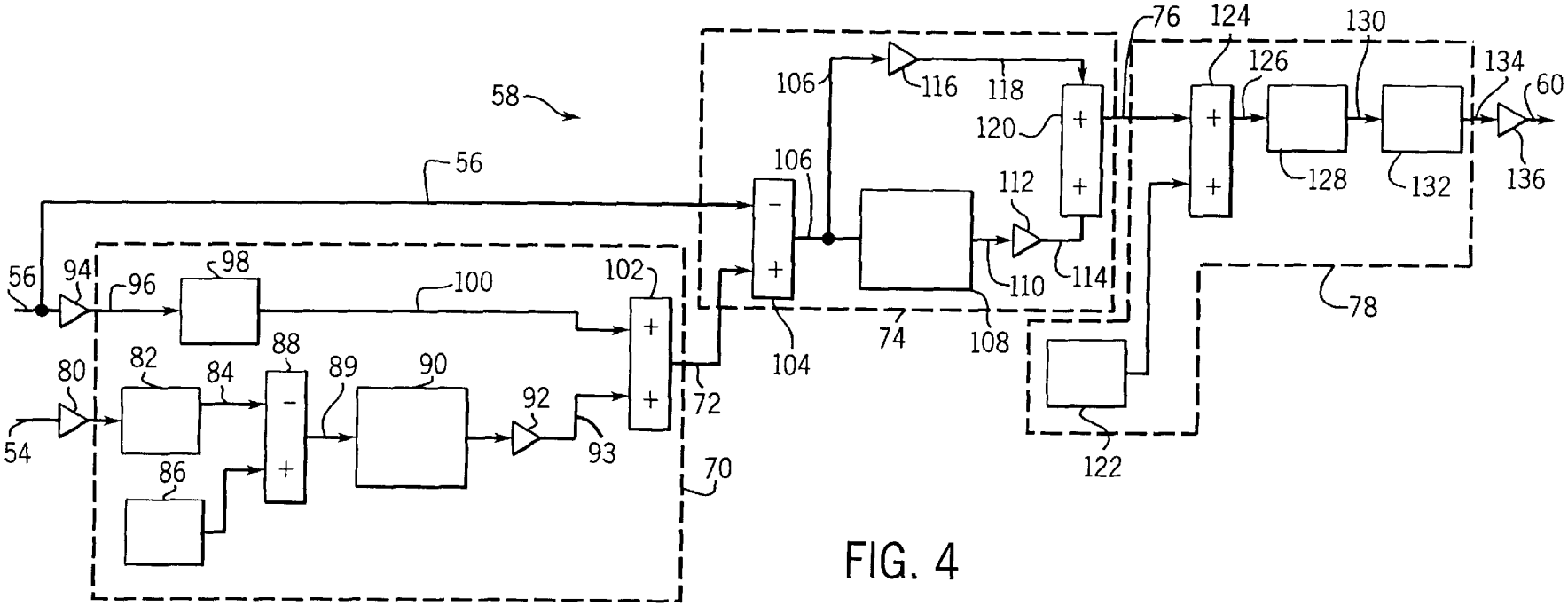
FIG. 4 is a schematic block diagram of the electronic controller forming part of the present invention.

Referring to FIG. 4, setpoint calculator 70 includes amplifiers 80, 92, and 94; a voltage to displacement converter 82; a position setpoint memory 86; a differencing junction 88; a deadzone nonlinearity circuit 90; a single pole low-pass filter 98; a summing junction 102; a position error signal bus 89; and signal buses 84, 93, 96, and 100. Pressure regulator 74 includes a differencing junction 104; a state estimation circuit 108; a derivative gain circuit 112; a proportional gain circuit 116; a summing junction 114; an error signal bus 106; a time rate of change of pressure error signal connection 110; and signal connections 114 and 118. Nonlinear converter 78 includes a pressure signal bias memory 122; a summing junction 124; a coulombic friction circuit 128; a saturation circuit 132; an amplifier 136; and signal buses 126, 130, and 134.

Data bus 54 and 56 are connected to the input side of setpoint calculator 70. Data bus 54 is connected to amplifier 80. The output of amplifier 80 is connected to converter 82. The output of converter 82 and memory 86 are connected to differencing junction 88.

Setpoint calculator 70 receives a signal from position signal data bus 54. This signal is amplified by amplifier 80 to generate a signal applied to converter 82 which seals the signal to correspond (e.g. proportional to) to displacement of lift arms 22. The sealed signal is compared with position setpoint selected with memory 86 at differencing junction 88 to generate an error signal. The error signal is communicated to deadzone nonlinearity 90 which provides a zero output when the position of the lift arms 22 are within a predetermined range of the setpoint (e.g. two degrees). Thus, deadzone nonlinearity 90 ensures that the position control does not interfere with small motions created by the pressure control. The signal output by deadzone nonlinearity circuit 90 is amplified by amplifier 92, set at 0.02 in the present embodiment. Amplifier 92 modifies the signal to correspond to actuator pressure when applied to summing junction 102 as discussed in further detail below.

Setpoint calculator 70 also receives a sampled pressure signal from data bus 56. The sampled pressure signal is multiplied by amplifier 94. This signal is communicated via bus 96 to single pole low-pass filter 98 which has a cut-off frequency at 0.1 Hz in the present embodiment. The signals from low-pass filter 98 and amplifier 92 are passed via busses 100 and 93, respectively, to summing junction 102 where they are added to produce a pressure setpoint signal and are applied to pressure regulator 74.

Pressure signal data bus 56 and pressure setpoint signal bus 72 are connected to the input side of pressure regulator 74. Busses 56 and 72 are connected to summing junction 104. The output connection 106 of summing junction 104 is split, and coupled with state estimator 108 and proportional gain-circuit 116. Bus 110 of state estimation circuit 108 is connected to derivative gain amplifier 112. Bus 114 of amplifier 112 and bus 118 of proportional gain amplifier 116 are connected to summing junction 120 which is connected to ideal pressure control signal bus 76.

Pressure regulator 74 receives the sampled pressure signal over data bus 56 and the calculated pressure setpoint signal over bus 72. The two signals are compared using differencing junction 104 which produces a pressure error signal that is applied to proportional gain amplifier 116 and state estimation circuit 108. State estimator 108 calculates an estimate of the time rate of change of the pressure error signal. This signal is applied to derivative gain amplifier 112 (e.g. amplification of 5 to 1), which multiplies the signal and applies it to summing junction 120. Proportional gain amplifier 116 (e.g. amplification of 40 to 1) multiplies the signal and applies the multiplied signal to summing junction 120. The signals communicated over busses 118 and 114 to junction 120 are both added by summing junction 120 to yield the ideal pressure control signal which is applied to nonlinear converter 78 via bus 76.

Pressure control signal bus 76 is connected to the input side of nonlinear conversion circuit 78. Bus 76 and offset memory 122 are both connected to summing junction 124. Output bus 126 of summing junction 124 is connected to coulombic friction element 128, and coulombic friction element 128 is connected to saturation element 132. Output connection 134 couples saturation element 132 to amplifier 136 which is connected to control signal data bus 60.

The purpose of nonlinear conversion circuit 78 is to transform the ideal pressure control signal to a valve command signal which takes into account nonlinear effects of valve 40 including frictional losses and saturation in which the valve has some maximum hydraulic fluid flow rate. Circuit 78 adds the ideal pressure control signal to the value set by circuit 122 at summing junction 124. The purpose of the bias is to make a no-flow command correspond to the center position of the valve. Summing junction 124 communicates a signal over bus 126 to coulombic friction circuit 128. Coulombic friction circuit 128 compensates for the deadband of electronic valve 40, and modifies the signal based upon the deadband. Circuit 128 adds a positive offset to positive signals and adds a negative offset to negative signals. Coulombic friction circuit 128 communicates a signal over connection 130 to saturation element 132. Saturation element 132 models the maximum and minimum flow limitations of electronic valve 40 and clips the signal if it corresponds to flow values outside of the maximum or minimum flow values of the valve. Saturation element 134 communicates a signal over connection 136 to amplifier 136 which generates the sampled valve command which is communicated over control signal data bus 60. In the preferred embodiment circuits 70, 74 and 78 are implemented with a programmed digital processor. Thus, prior to amplification by amplifier 136, the flow control signal would be applied to DAC 62.

The type of work vehicles and excavators to which the described ride control can be applied includes, but is not limited to, backhoes, snowplows, cranes, skid-steer loaders, tractors including implements such as plows for earth working, wheel loaders (see FIG. 1), and other construction or utility vehicles having an implement, arm, or boom moveable relative to the vehicle frame. The ride control system is not limited to vehicles with a pair of lift arms 22 such as the wheel loader 10, but may also be applied to vehicles with a multiplicity of lift arms or a single lift arm such as on a backhoe or a crane.

The actuation devices, used to move the implements, are used to dampen bouncing and pitching of the vehicle by appropriately moving the implement relative to the vehicle frame. The ride control system may be applied to vehicles using various types of hydraulic actuation systems including hydraulic actuators 24 and hydraulic motors.

The electronic controller 58 shown in FIG. 2 is a programmed microprocessor but can also be other electronic circuitry, including analog circuitry, that provides the proper control signal to the electronic valve 40 to keep the pressure in the hydraulic actuator 24 substantially constant. The programming of the microprocessor is not limited to the method described above. An appropriate control scheme can be used such that the goal is to keep the hydraulic cylinder pressure constant. Such control techniques include but are not limited to classical control, optimal control, fuzzy logic control, state feedback control, trained neural network control, adaptive control, robust control, stochastic control, proportional-derivative (PD) control, and proportional-integral-derivative control (PID).

The sensor used to generate the acceleration signal is not limited to the pressure transducer 46 but an accelerometer or other sensor for directly sensing acceleration may be used. In an alternate embodiment, the pressure signal generated by transducer 46 can be replaced or supplemented with the acceleration signal generated by an accelerometer. Preferably, the accelerometer would be configured to generate a signal representative of acceleration in a direction substantially perpendicular to the surface upon which the work vehicle rests. In this embodiment, system 50 is configured to maintain acceleration substantially constant at zero.

Low-pass filter 98 is not limited to a filter with cut-off frequency of 0.1 Hz but only requires a filter with cut-off frequency that is substantially below the natural resonant frequency of the vehicle/tire system. The low-pass filter 98 is also not limited to being a single pole filter, but may be a filter having multiple poles. The gain values and offset constants are not limited to the values described above but may be set to any values that will achieve the goal of keeping the hydraulic actuator pressure substantially constant while keeping the implement in a generally fixed position. The ride control system is further not limited to having both a position sensor 48 as well as a pressure transducer 46, but may function without the position sensor. The position sensor aids in limiting the implement to relatively small displacements. If the ride control system is to include position sensor 48, it may be but is not limited to be a rotary potentiometer, which measures angular position of the lift arms, or a linear voltage displacement transducer (LVDT), which measures the extension or distension of actuator shaft 23.

From the foregoing, it will be observed that numerous modifications and variations can be effected without departing from the true spirit and scope of the novel concept of the present control system. It will be appreciated that the present disclosure is intended as an exemplification of the control system, and is not intended to limit the control system to the specific embodiment illustrated. The disclosure is intended to cover by the appended claims all such modifications as fall within the scope of the claims.

What is claimed is:

1. A control system for a work vehicle of the type including an implement moveable relative to the vehicle, the system comprising:

a hydraulic fluid source;

a hydraulic actuator couplable between the vehicle and the implement to lift the implement;

an electronic valve coupled to the source and the actuator to control the flow of hydraulic fluid applied to the actuator by the source;

a pressure transducer in fluid communication with the hydraulic fluid applied to the actuator to generate a pressure signal related to the pressure in the actuator;

a position transducer mechanically couplable between the implement and the vehicle to generate a position signal representative of the position of the implement with respect to the vehicle: and an electronic controller coupled to the electronic valve, the pressure transducer, and the position transducer, the controller generating valve command signals based upon the pressure signal and the position signal and applying the command signals to the electronic valve to cause the electronic valve to control the flow of hydraulic fluid applied to the actuator to maintain the pressure signal substantially constant.

2. The control system of claim 1, wherein the hydraulic actuator is a hydraulic cylinder couplable between the implement and the work vehicle.

3. The control system of claim 1, wherein the hydraulic actuator is a hydraulic motor couplable between the implement and the work vehicle.

4. The control system of claim 1, wherein the electronic controller includes a microprocessor, an analog-to-digital converter coupled to the pressure transducer, the position transducer, and the microprocessor, and a digital-to-analog converter coupled to the electronic valve and the microprocessor.

5. An excavator comprising:

a wheeled vehicle;

an implement movably supported by the vehicle;

a hydraulic fluid source supported by the vehicle;

a hydraulic actuator coupled between the implement and vehicle to lift the implement relative to the vehicle;

an electronic valve coupled to the source and the actuator to control the flow of hydraulic fluid applied to the actuator by the source;

means for generating a pressure signal representative of the pressure in the actuator;

means mechanically coupled between the implement and the wheeled vehicle for generating a position signal representative of the position of the implement with respect to the wheeled vehicle; and an electronic controller coupled to the electronic valve, the means for generating a pressure signal, and the means for generating a position signal, the controller applying control signals derived from the pressure signal and the position signal to the electronic valve to cause the electronic valve to control the flow of hydraulic fluid applied to the actuator to maintain the pressure signal substantially constant.

6. The excavator of claim 5, wherein the means for generating a pressure signal includes a pressure transducer in fluid communication with the hydraulic actuator and responsive to the pressure in the actuator.

7. The excavator of claim 5, wherein the hydraulic actuator is a hydraulic cylinder.

8. The excavator of claim 5, wherein the hydraulic actuator is a hydraulic motor.

9. The excavator of claim 5, wherein the electronic controller includes a microprocessor, an analog-to-digital converter coupled to the means for generating a pressure signal, the means for generating a position signal, and the micro processor, and a digital-to-analog converter coupled to the electronic valve and the microprocessor.

10. The excavator of claim 5, wherein the position signal is combined with the pressure signal to minimize a position signal error.

11. The excavator of claim 10, wherein the position signal error is indicated by a difference between the position signal and a position setpoint.

12. The control system of claim 1, wherein the position signal is combined with the pressure signal to minimize a position signal error.

13. The control system of claim 12, wherein the position signal error is indicated by a difference between the position signal and a position setpoint.

14. The control system of claim 1, the controller to generate a pressure error signal from the pressure signal and the position signal and to base the valve command signals on the pressure error signal.

15. The control system of claim 14, the controller to calculate an estimate of the time rate of change of the pressure error signal, and to base the valve command signals on the estimate.

16. The excavator system of claim 5, the controller to generate a pressure error signal from the pressure signal and the position signal and to base the control signals on the pressure error signal.

17. The excavator system of claim 16, the controller to calculate an estimate of the time rate of change of the pressure error signal, and to base the control signals on the estimate.

18. A control system for reducing the oscillation of a work vehicle as it moves across a surface, the work vehicle of the type including an implement moveable relative to the vehicle, the system comprising:

a hydraulic fluid source;

a hydraulic actuator couplable between the vehicle and the implement to lift the implement;

an electronic valve coupled to the source and the actuator to control the flow of hydraulic fluid applied to the actuator by the source;

a pressure transducer in fluid communication with the hydraulic fluid applied to the actuator to generate a pressure signal related to the pressure in the actuator;

a position transducer mechanically coupleable between the implement and the vehicle to generate a position signal representative of the position of the implement with respect to the vehicle; and an electronic controller coupled to the electronic valve, the pressure transducer, and the position transducer, the controller generating valve command signals based upon the pressure signal and the position signal and applying the command signals to the electronic valve to cause the electronic valve to control the flow of hydraulic fluid applied to the actuator to reduce the oscillation of the work vehicle as it moves across the surface.

19. The control system of claim 18, wherein the hydraulic actuator is a hydraulic cylinder couplable between the implement and the work vehicle.

20. The control system of claim 18, wherein the hydraulic actuator is a hydraulic motor couplable between the implement and the work vehicle.

21. The control system of claim 18, wherein the electronic controller includes a microprocessor, an analog-to-digital converter coupled to the pressure transducer, the position transducer, and the microprocessor, and a digital-to-analog converter coupled to the electronic valve and the microprocessor.

22. The control system of claim 18, wherein the position signal is combined with the pressure signal to minimize a position signal error.

23. The control system of claim 22, wherein the position signal error is indicated by a difference between the position signal and a position setpoint.

24. The control system of claim 18, the controller to generate a pressure error signal from the pressure signal and the position signal and to base the valve command signals on the pressure error signal.

25. The control system of claim 24, the controller to calculate an estimate of the time rate of change of the pressure error signal, and to base the valve command signals on the estimate.

26. The control system of claim 18, wherein the position transducer senses position over the full range of motion of the implement with respect to the vehicle.

27. The control system of claim 1, wherein the position transducer senses position over the full range of motion of the implement with respect to the vehicle.

28. The excavator of claim 5, wherein the means for generating a position signal senses position over the full range of motion of the implement with respect to the vehicle.

* * * * *